United States Patent [19]

Krautter et al.

[11] 4,236,663

[45] Dec. 2, 1980

[54] HINGE-LID PACK, MORE PARTICULARLY FOR CIGARETTES

[75] Inventors: Hermann Krautter, Laudenbach; Heinz Focke, Verden, both of Fed. Rep. of Germany

[73] Assignee: Focke & Co., Verden, Fed. Rep. of Germany

[21] Appl. No.: 22,564

[22] Filed: Feb. 28, 1979

[30] Foreign Application Priority Data

Jun. 28, 1977 [DE] Fed. Rep. of Germany ... 7720179[U]
Mar. 28, 1978 [DE] Fed. Rep. of Germany ..... 2813390

[51] Int. Cl.[2] ..... B65D 85/10
[52] U.S. Cl. ..... 229/44 CB
[58] Field of Search ..... 229/44 CB

[56] References Cited

U.S. PATENT DOCUMENTS

| | | | |
|---|---|---|---|
| 2,951,626 | 9/1960 | Weiss | 229/44 CB |
| 3,048,320 | 8/1962 | Hovland et al. | 229/44 CB X |
| 3,327,888 | 6/1967 | Chalmers et al. | 229/44 CB X |
| 3,979,047 | 9/1976 | Focke et al. | 229/44 CB |

FOREIGN PATENT DOCUMENTS

| | | | |
|---|---|---|---|
| 1018781 | 10/1957 | Fed. Rep. of Germany | 229/44 CB |
| 2426131 | 12/1975 | Fed. Rep. of Germany | 229/44 CB |

OTHER PUBLICATIONS

WO 79/00034, Jan. 25, 1979, Focke et al.

*Primary Examiner*—Davis T. Moorhead
*Attorney, Agent, or Firm*—Sughrue, Rothwell, Mion, Zinn and Macpeak

[57] ABSTRACT

In a folding box having a collar surrounded by a lid in the closed position, this collar is formed in one piece with the blank of the box. By means of a number of separating cuts, however, the collar is defined in relation to the blank in such a manner that in the area of the front wall of the box the inwardly displaced collar is only connected with the box blank, namely the front wall thereof, by means of residual connections. These side residual connections are folded inward in the form of a Z in such a manner that outside of the residual connections the collar lies smoothly against the inside of the front wall.

5 Claims, 7 Drawing Figures

Figure 4:
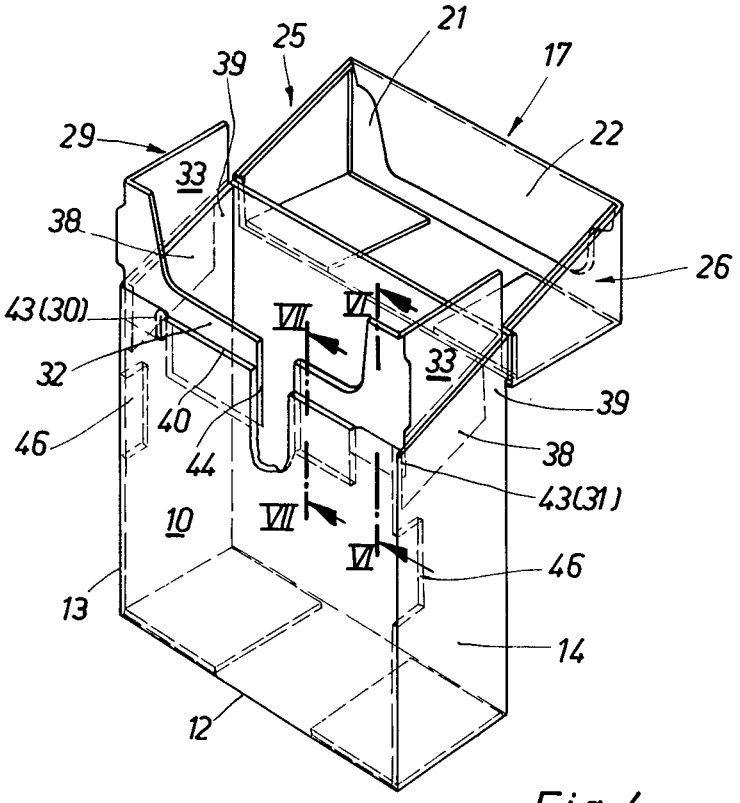

Fig.1
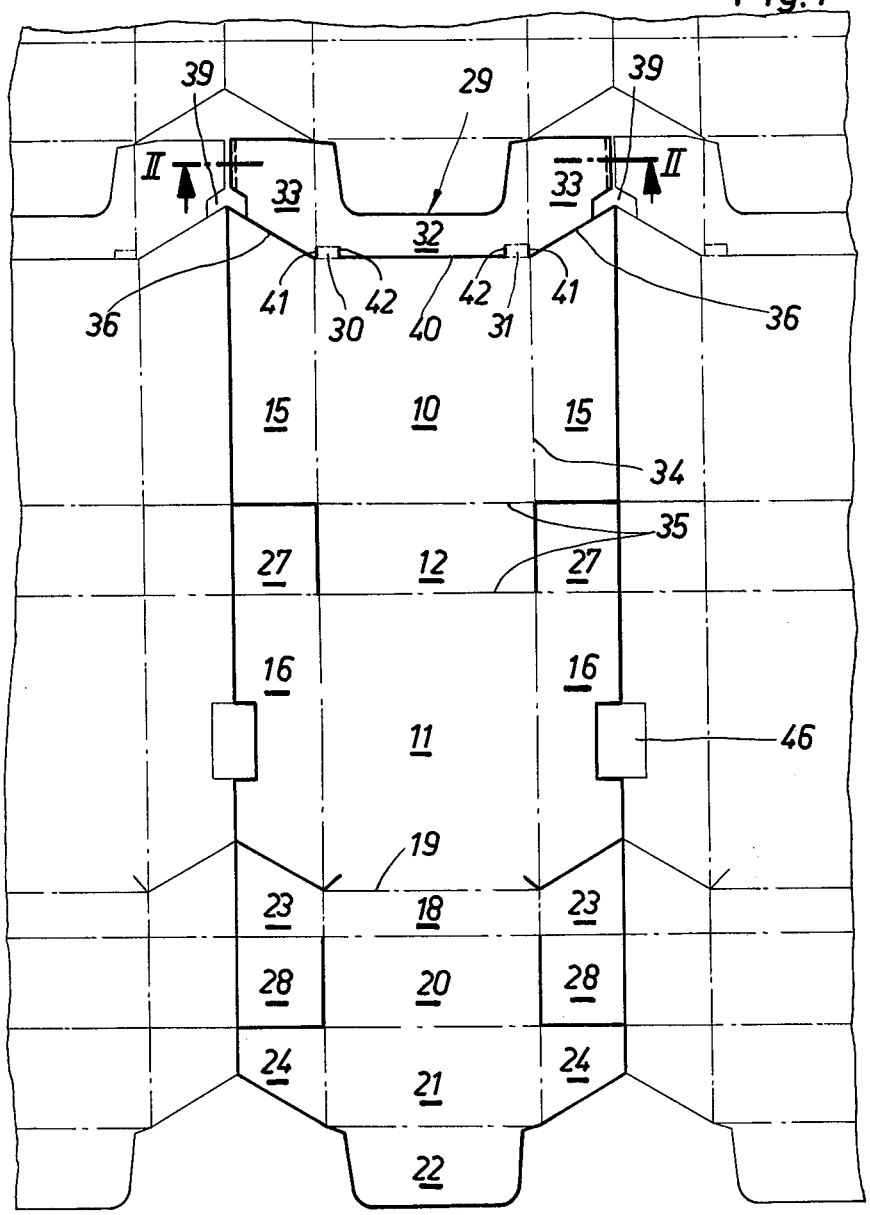
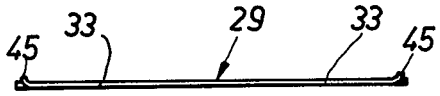
Fig.2
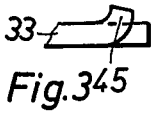
Fig.3

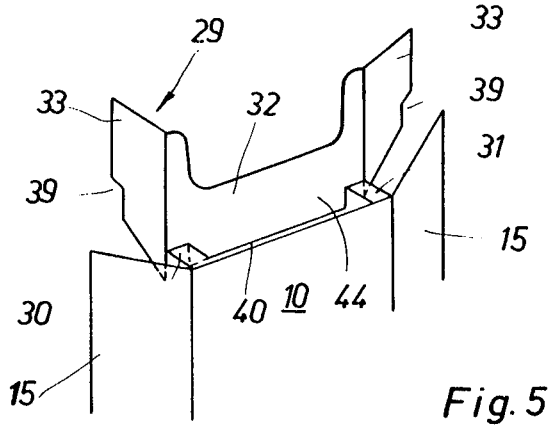
Fig. 5
Fig. 6
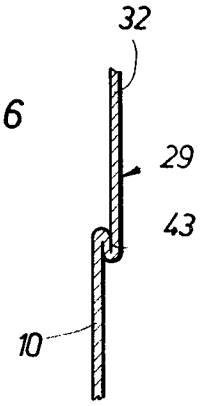
Fig. 7
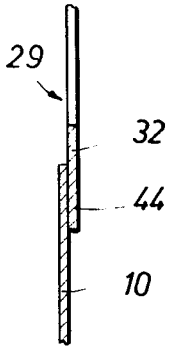

HINGE-LID PACK, MORE PARTICULARLY FOR CIGARETTES

The invention relates to a hinge-lid pack, more particularly for cigarettes, comprising a unitary blank having a lid hinged to a rear wall, the lid engaging in the closed position around a collar connected to a front wall, the collar being set back inwardly near the front wall by a Z fold formed from an intermediate strip.

A pack of this kind is disclosed e.g. by German Offenlegungsschrift No. 2 426 131. The complete pack disclosed thereby comprises a single unitary blank of paper, cardboard or the like. Consequently, the conventional collar of such hinge-lid packs is a part of the blank and is connected to the pack front wall. To achieve the stepping conventionally found in such packs between, on the one hand, the pack front wall and side walls and, on the other hand, the collar and side collar tabs, a Z fold is provided in the known pack near the front wall and on the side walls as a connection between the collar and the front wall and side wall. Because of this Z fold, the collar including its tabs is set back by two layers of material from the front wall and side walls. Consequently, the lid, which is also embodied by two layers, terminates flush with the front wall and the side wall in the closed position.

It is an object of the invention to suggest an improved hinge-lid pack of the kind described which is simpler, more particularly as regards low-cost mechanical manufacture, and has advantages in handling.

According to the invention, therefore, opposite a top edge of the front wall most of the intermediate strip (to form the Z fold) is separated by a transverse parting cut in such a manner that a Z fold is formed only in the area of residual connections between the collar and the front wall, and outside the Z fold the intermediate strip engages directly and in the unfolded state with the inside of the front wall.

The pack construction according to the invention near the connection between the front wall and the collar facilitates mechanical production since a relatively narrow intermediate strip can be folded satisfactorily by mechanical means. According to the invention, instead of a Z fold being produced over the whole width of the front wall, something which is difficult to contrive mechanically, the collar is merely moved in a plane offset from the front wall so that the flat intermediate strip arising between the residual connections is supported on the inside of the front wall. If required, this part of the intermediate strip can be connected to the inside of the front wall by gluing or the like.

The side collar tabs are in known manner separated from the adjacent front wall side tabs by an inclined cut and secured at an area at the bottom between the overlapping side tabs of the front wall and rear wall. According to the invention, the collar tabs are formed over the height of this securing between the side tabs with an aperture near the pack rear wall, such aperture obviating the formation of three layers at the back of the pack. This feature improves the external optical appearance made by the pack. This feature of the invention can be used independently of the connection hereinbefore described between the collar and the front wall.

Other features of the invention concern the construction of the pack.

An embodiment of the hinge-lid pack according to the invention will be described in greater detail hereinafter with reference to the drawings wherein:

FIG. 1 shows blanks spread out adjacent one another,

FIG. 2 is a cross-section on the line II—II of FIG. 1 through a collar of the blank, FIG. 3 is a greatly enlarged view of an edge area of the detail of FIG. 2, FIG. 4 is a perspective view, partly cut away, of a hinge-lid pack devised from a blank of the kind shown in FIG. 1, the lid of the pack being open, FIG. 5 is a perspective view showing part of the front of the pack including the collar during one phase of production of the pack, FIG. 6 is a cross-section on the line VI—VI near the pack front wall and in an enlarged scale, and FIG. 7 is a cross-section on the line VII—VII near the front wall.

The embodiment shown of a pack is for an oblong prismatic hinge-lid pack for cigarettes. The pack comprises a front wall 10, rear wall 11, bottom 12 and side walls 13, 14. The latter are for the most part devised in two layers, consisting of side flaps or tabs 15, 16 connected to the front wall 10 and rear wall 11.

Connected to the top edge of rear wall 11 is a pivoting lid 17 whose rear wall 18 is unitary with rear wall 11 and pivotable along a fold axis 19.

In other respects, the lid 17 comprises a top wall 20, front wall 21 and a reinforcing flap or tab 22 folded over against the inside of the lid. The lid rear wall 18 and its front wall 21 have lateral trapezoidal side flaps 23, 24 respectively, which fold over each other to form further two-layer lid side walls 25, 26. Also, corner flaps or tabs 27, 28 are provided near the pack bottom 12 and lid 17 respectively and engage with the bottom 12 and lid top wall 20 respectively of the finished pack.

In the pack blank as so far described, a collar 29 is connected in the area of the front wall 10 and is unitarily connected to the rest of the blank by way of residual connections 30, 31. The collar 29 is embodied by a front wall 32, as a continuation of the front wall 10, and side collar tabs 33 near the adjacent side tabs or flaps 15.

The areas of the blank or pack so far described are defined from one another by longitudinal fold lines 34 and transverse fold lines 35.

The lateral parts of the blank—i.e., the side flaps 15 and collar tabs 33 and the side flaps 16 and the lid side flaps 23, are completely separated from one another over their full width by inclined cuts 36, 37. Because of the inclination of about 30° of the cuts 36, 37, correspondingly inclined closing edges of the pack and lid and a bottom inclined edge of the collar tabs 33 are formed.

The blank hereinbefore described is folded in known manner by the longitudinal folding method to form the pack shown in FIG. 4, the folding of the lid 17 being conventional. There are special features in the area of the collar 29.

The side collar tabs 33 are embedded and anchored, more particularly by gluing, between the side wall flaps 15, 16 in the top part thereof by means of a bottom anchor strip 38 which can be e.g. approximately 5 mm high. This area, therefore, is made up of three layers of material. So that these three layers are not visible at the back of the pack—i.e., at the top side edges of the rear wall 11—each collar tab 33 is formed with an aperture 39 open to the back. Preferably, the aperture is of the same height as the strip 38. Consequently, the side flaps 15, 16 are immediately contiguous with one another in the area of the aperture 39. There is a specially devised connection between the collar 29 and the front wall 10. In the present embodiment there are narrow residual lateral connections 30, 31. Except for these connections 30, 31 the collar 29—i.e., its front wall 32—is separated from the front wall 10 by a cut 40. Lateral cuts 41, 42 separate the connections 30, 31 from the nearby parts of the collar 29.

In the production of the pack, the collar 29 is moved in a set-back plane by relative movement opposite to the front wall 10 in such a manner that the residual connections 30, 31 are folded against the back of the rear wall 10. The part of the collar front wall 32 which overlaps the pack front wall 10 is supported by the back thereof. A Z fold 43, (FIG. 6) is therefore produced in the area of the residual connections 30, 31 together with the adjacent areas of the pack front wall 10 and collar front wall 32. Except for these residual connections 30, 31 the collar front wall 32 engages by way of a hypothetical intermediate strip 44 with the inside of the front wall 10. The intermediate strip 44 is twice as wide as the inner arm of the Z fold 43, having, for example, a height or width of 5 mm. The collar tabs 33 are moved the same amount by this relative movement into the region of the side flaps 15, 16 and engaged therebetween.

Consequently, the closing edge formed in this case by the top edge of the pack front wall 10 and of the outside flaps 15 consists of a single layer whereas the associated closing edge of the lid 17 consists of two layers. This makes it easier to open the lid 17 since there is a step or shoulder between lid 17 and the rest of the pack.

The blanks of the present embodiment are so embodied that only limited amounts of waste produced by punching result. More particularly, the collar tabs 33 are originally formed to be of the same width as the contiguous side flaps 15. However, to ensure that in the finished pack there is no unwanted projection of the inside collar tabs 33, their width is subsequently reduced from the original width by an impressed marginal raised part 45 visible in FIGS. 2 and 3.

In the present embodiment the inwardly disposed side flaps 16 are formed with an aperture 46 open towards the edge, to enable the blank to be secured temporarily while the pack is being folded and filled in a pocket of a folding turret.

We claim:

1. A hinge-lid pack, more particularly for cigarettes, comprising a unitary blank having a lid hinged to a rear wall, the lid engaging in the closed position around a collar connected to a front wall, the collar being set back inwardly near the front wall by a Z fold formed from an intermediate strip, characterised in that opposite a top edge of the front wall (10) most of the intermediate strip (44) is separated by a transverse parting cut (40) in such a manner that a Z fold is formed only in the region of residual connections (30, 31) between the collar (29) and the front wall (10), and outside the Z fold the intermediate strip (44) engages directly and in the unfolded state with the inside of the front wall (10).

2. A pack according to claim 1, characterised in that the residual connections (30, 31) are disposed at the edge of the front wall (10) and are separated by side cuts (41, 42) from the laterally adjacent parts of the blank.

3. A pack according to claim 1 or 2, characterised in that the intermediate strip (44) is connected to the front wall (10) outside the area of the residual connections (30, 31) by gluing or the like.

4. A pack according to any of claims 1 to 3, characterised in that the collar tabs (33) are of the same width as side tabs (15, 16) to form side walls (13, 14) of the pack, the collar tabs (33) having their effective width reduced by marginal embossings, more particularly raised edge parts (45) formed by shaping.

5. A pack according to any of claims 1 to 4, characterised in that the collar tabs (33) are formed on the bottom corner near a back wall (11) with an aperture (39) of the same height as an anchoring strip (38) of the collar tabs (33) between the side tabs (15, 16).

* * * * *